US008210855B1

(12) United States Patent
Lin

(10) Patent No.: US 8,210,855 B1
(45) Date of Patent: Jul. 3, 2012

(54) ELECTRICAL CONNECTOR

(75) Inventor: Jui-Pin Lin, New Taipei (TW)

(73) Assignee: Cheng Uei Precision Industry Co., Ltd., New Taipei (TW)

( * ) Notice: Subject to any disclaimer, the term of this patent is extended or adjusted under 35 U.S.C. 154(b) by 0 days.

(21) Appl. No.: 13/046,695

(22) Filed: Mar. 11, 2011

(51) Int. Cl.
*H01R 12/00* (2006.01)

(52) U.S. Cl. ..... 439/66; 439/700; 439/824

(58) Field of Classification Search ..... 439/91, 439/66, 824, 700
See application file for complete search history.

(56) References Cited

U.S. PATENT DOCUMENTS

| | | | | |
|---|---|---|---|---|
| 4,636,026 | A * | 1/1987 | Cooney et al. | 439/482 |
| 4,838,801 | A * | 6/1989 | Bertoglio et al. | 439/83 |
| 5,192,213 | A * | 3/1993 | Kosugi et al. | 439/66 |
| 5,215,472 | A * | 6/1993 | DelPrete et al. | 439/71 |
| 5,362,241 | A * | 11/1994 | Matsuoka et al. | 439/66 |
| 7,025,602 | B1 * | 4/2006 | Hwang | 439/66 |
| 7,097,485 | B1 * | 8/2006 | Wang et al. | 439/289 |
| 7,256,593 | B2 * | 8/2007 | Treibergs | 324/754.05 |
| 7,285,026 | B1 * | 10/2007 | Ju et al. | 439/700 |
| 7,438,586 | B2 * | 10/2008 | Ju | 439/398 |
| 7,794,237 | B1 * | 9/2010 | Terhune, IV | 439/71 |
| 7,972,184 | B2 * | 7/2011 | Hsieh et al. | 439/700 |

* cited by examiner

*Primary Examiner* — Gary F. Paumen
(74) *Attorney, Agent, or Firm* — Lin & Associates IP, Inc.

(57) ABSTRACT

An electrical connector includes a pedestal terminal which has a base board, two fastening boards extending upward from two sides of the base board, and two elastic boards extending upward from two free ends of the fastening boards and inclined gradually away from each other in process of extending upward, and a connecting terminal having two elastic arms and a bent portion connecting the elastic arms together to make the connecting terminal show a substantial inverted-V shape. Two free ends of the elastic boards are bent inward to form two restraining portions. Two free ends of the elastic arms are arched outward to form two interfering portions. The connecting terminal is movably engaged with the pedestal terminal with the elastic arms restrained between the restraining portions, the interfering portions abutting against insides of the corresponding elastic boards and the bent portion projecting upward beyond the pedestal terminal.

3 Claims, 4 Drawing Sheets

ELECTRICAL CONNECTOR

BACKGROUND OF THE INVENTION

1. Field of the Invention

The present invention relates to a connector, and more particularly to an electrical connector having a plurality of terminal assemblies.

2. The Related Art

A traditional electrical connector generally includes an insulating housing and a plurality of terminal assemblies disposed in the insulating housing respectively. Referring to FIG. 1, the electrical connector is a probe connector and the terminal assembly is a probe pin which includes a metal barrel 10', a plunger 20' and a spring 30'. The metal barrel 10' has a cylindrical shell 11' and a bottom pedestal 12' connected with and sealing up a bottom of the shell 11'. The plunger 20' has one end thereof movably inserted in the shell 11' and the other end thereof projected out of a top end of the shell 11'. The one end of the plunger 20' inserted in the shell 11' has a bottom face recessed upward to form a restraining recess 21'. The spring 30' is disposed in the shell 11' with a top end thereof restrained in the restraining recess 21' and a bottom end thereof restrained in the bottom pedestal 12'. So the plunger 20' can move upward and downward under the action of the spring 30'. However, the probe pin of the probe connector is composed of many components, such as the metal barrel 10', the plunger 20' and the springs 30', so that results in a complicated structure, manufacture and assembly process of the probe pin.

SUMMARY OF THE INVENTION

An object of the present invention is to provide an electrical connector. The electrical connector includes an insulating housing having a top surface recessed downward to define a plurality of openings and a bottom surface recessed upward to define a plurality of receiving cavities of which each is aligned with one of the openings and further connected with the corresponding opening, and a plurality of terminal assemblies inserted upward into the receiving cavities of the insulating housing respectively. Each of the terminal assemblies includes a pedestal terminal and a connecting terminal. The pedestal terminal has a base board, two fastening boards extending upward from two side edges of the base board, and a pair of elastic boards further extending upward from two free ends of the fastening boards. The elastic boards are inclined oppositely to each other and gradually far away from each other in the process of extending upward. Two free ends of the pair of elastic boards are bent towards each other to form a pair of restraining portions. The connecting terminal has a pair of elastic arms, and a bent portion connecting the pair of elastic arms together to make the connecting terminal show a substantial inverted-V shape. Two free ends of the elastic arms are arched oppositely to each other to form a pair of interfering portions. The connecting terminal is movably engaged with the pedestal terminal with the elastic arms restrained between the restraining portions and the interfering portions elastically abutting against insides of the corresponding elastic boards to realize an electrical connection between the connecting terminal and the pedestal terminal. The pedestal terminal is secured in the corresponding receiving cavity with the base board blocking under the receiving cavity, and the two ends of the elastic boards adjacent to the restraining portions elastically rest against insides of the receiving cavity. The bent portion of the connecting terminal passes through the corresponding opening to movably project beyond the top surface of the insulating housing.

As described above, the electrical connector has the terminal assembly composed of the pedestal terminal and the connecting terminal movably engaged with each other. So it has a simple structure and assembly process, and is very easy to be manufactured.

BRIEF DESCRIPTION OF THE DRAWINGS

The present invention will be apparent to those skilled in the art by reading the following description thereof, with reference to the attached drawings, in which.

DETAILED DESCRIPTION OF THE PREFERRED EMBODIMENT

Figure 1:
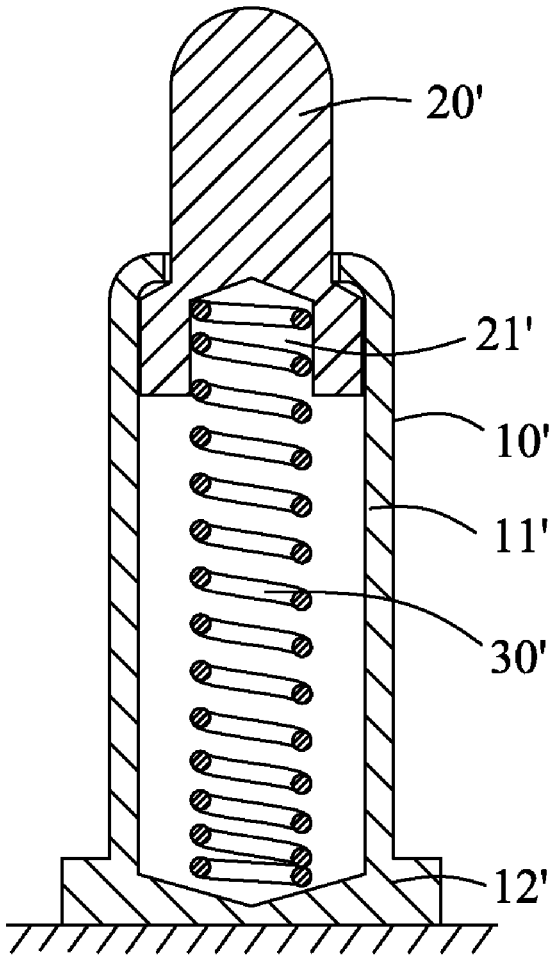
FIG. 1 (Prior Art)
FIG. 1 is a cross-sectional view of a probe pin of a traditional probe connector.
Figure 2:
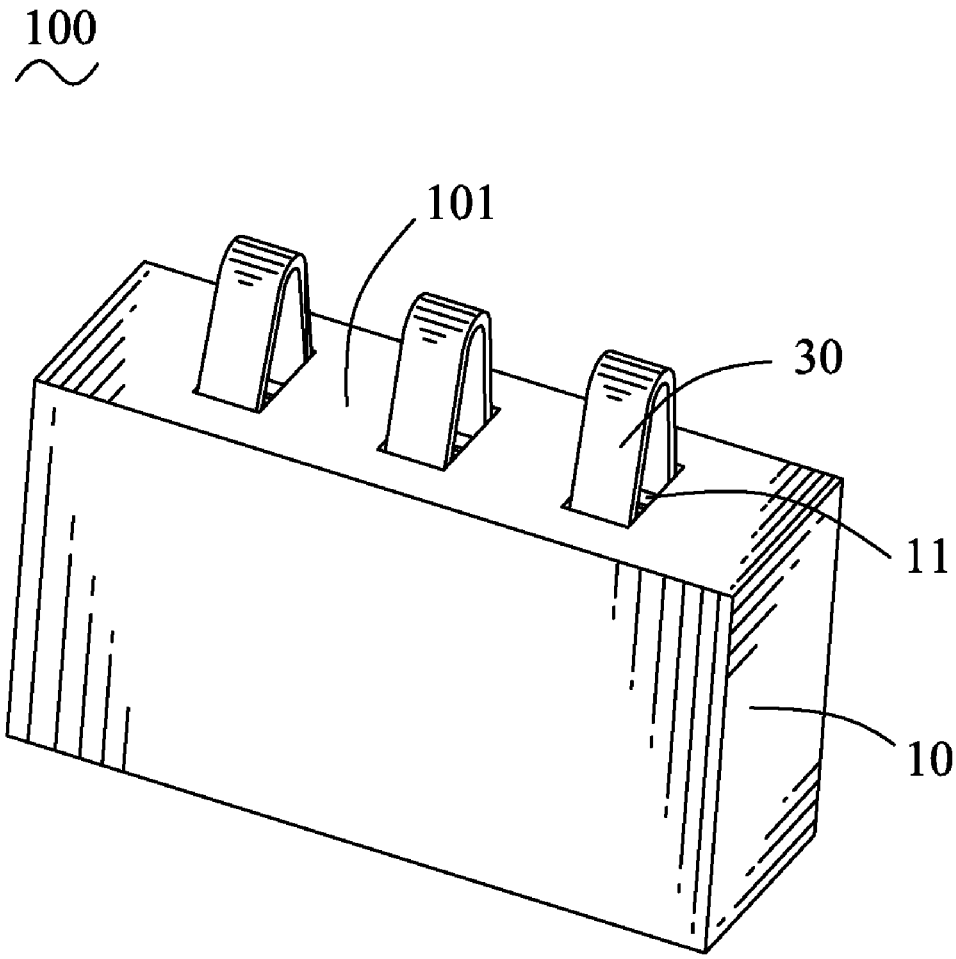
FIG. 2 is an assembled perspective view of an electrical connector according to an embodiment of the present invention.
Figure 3:
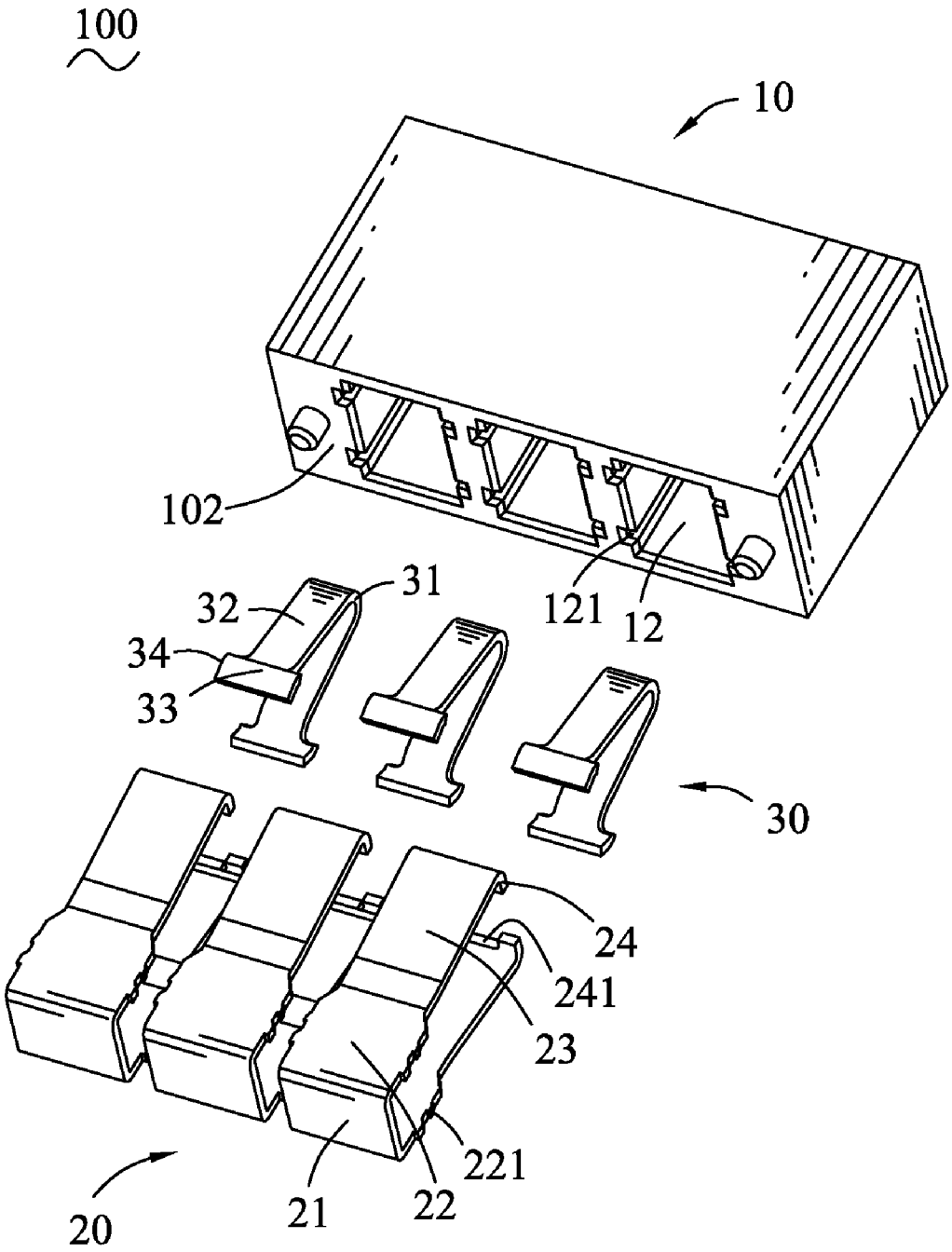
FIG. 3 is an exploded perspective view of the electrical connector of FIG. 2.

With reference to FIG. 2 and FIG. 3, an electrical connector 100 according to an embodiment of the present invention includes an insulating housing 10 and a plurality of terminal assemblies disposed in the insulating housing 10 respectively. Each terminal assembly includes a pedestal terminal 20 and a connecting terminal 30 movably engaged with the pedestal terminal 20 to realize an electrical connection with the pedestal terminal 20.

Referring to FIGS. 2-3 again, the insulating housing 10 is of rectangular shape, and has a top surface 101 recessed downward to define a plurality of rectangular openings 11 which are arranged at regular intervals. A bottom surface 102 of the insulating housing 10 opposite to the top surface 101 is recessed upward to define a plurality of rectangular receiving cavities 12 of which each is aligned with one of the openings 11 and further connected with the corresponding opening 11. Two opposite side faces of each receiving cavity 12 define two fastening grooves 121 communicating with the receiving cavity 12.

The pedestal terminal 20 is curved from a long rectangular metal plate. The pedestal terminal 20 has a rectangular base board 21, a pair of fastening boards 22 extending upward from two opposite side edges of the base board 21 and facing to each other perpendicularly to the base board 21, and a pair of elastic boards 23 further extending upward from two free ends of the fastening boards 22. The elastic boards 23 are inclined oppositely to each other and gradually far away from each other in the process of extending upward. Two free ends of the pair of elastic boards 23 are bent towards each other to form a pair of restraining portions 24 of which each has a restraining gap 241 opened at a middle thereof. Two opposite side edges of each of the fastening boards 22 protrude outwards to form a plurality of fastening teeth 221.

The connecting terminal 30 is curved from a long rectangular metal plate and substantially shows an inverted-V shape seen from a lateral view. The connecting terminal 30 has a pair of elastic arms 32, and a bent portion 31 connecting the pair of elastic arms 32 together to make the connecting terminal 30 show the substantial inverted-V shape. Two free ends of the elastic arms 32 are arched oppositely to each other to form a pair of interfering portions 33 of which two side edges of each oppositely protrude to form a pair of blocking portions 34.

Figure 4:
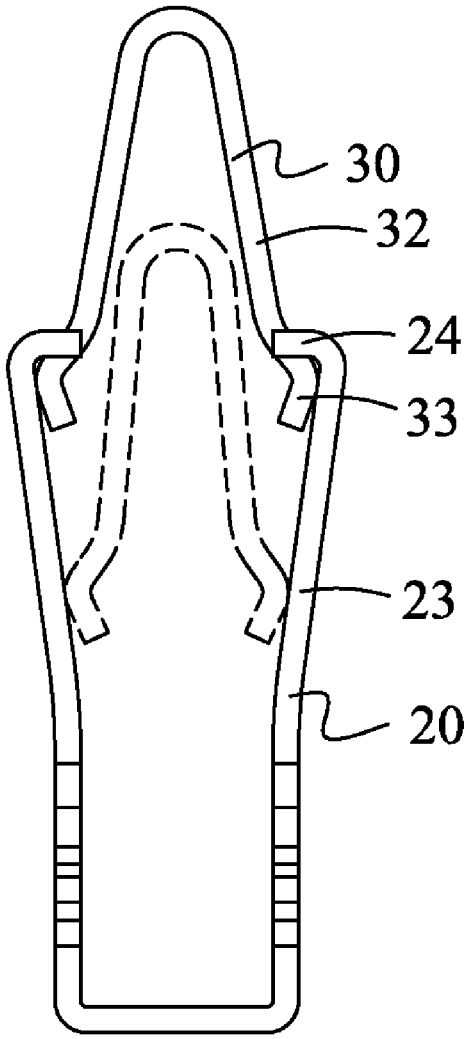
FIG. 4 is a view showing action states between a pedestal terminal and a connecting terminal of the electrical connector of FIG. 2.

Referring to FIGS. 2-4, in assembly, the connecting terminal 30 is movably engaged with the pedestal terminal 20 by means of the elastic arms 32 passing through the restraining gaps 241 respectively to make the interfering portions 33 elastically abut against insides of the corresponding elastic boards 23. So an electrical connection is realized between the connecting terminal 30 and the pedestal terminal 20. The connecting terminal 30 can move upward and downward between the elastic boards 23, by means of the elastic arms 32 being guided in the corresponding restraining gaps 241. The blocking portions 34 can be blocked by the corresponding restraining portions 24 so that further prevents the connecting terminal 30 from falling off the pedestal terminal 20. Then the terminal assemblies are inserted upward into the receiving cavities 12 of the insulating housing 10 respectively. The pedestal terminal 20 is secured in the corresponding receiving cavity 12 by means of the fastening teeth 221 being fastened in the fastening grooves 121. The base board 21 blocks under the receiving cavity 12. The two ends of the elastic boards 23 adjacent to the restraining portions 24 elastically rest against insides of the receiving cavity 12. The bent portion 31 of the connecting terminal 30 passes through the corresponding opening 11 to project beyond the top surface 101 of the insulating housing 10 for electrically contacting with a mating contact (not shown).

In use, when the connecting terminal 30 is pressed downward by the mating contact, the interfering portions 33 slide along the insides of the corresponding elastic boards 23 to make the elastic arms 32 elastically pressed towards each other. The connecting terminal 30 is clipped between the elastic boards 23 to make the bent portion 31 steadily contact with the mating contact. When the connecting terminal 30 is set free, the connecting terminal 30 moves upward along the insides of the corresponding elastic boards 23 under the resilience force of the elastic arms 32, until the blocking portions 34 are blocked by the restraining portions 24.

As described above, the electrical connector 100 has the terminal assembly composed of the pedestal terminal 20 and the connecting terminal 30 movably engaged with each other. So it has a simple structure and assembly process, and is very easy to be manufactured.

What is claimed is:

1. An electrical connector, comprising:

an insulating housing having a top surface recessed downward to define a plurality of openings, and a bottom surface recessed upward to define a plurality of receiving cavities of which each is aligned with one of the openings and further connected with the corresponding opening; and a plurality of terminal assemblies inserted upward into the receiving cavities of the insulating housing respectively, each of the terminal assemblies including a pedestal terminal having a base board, two fastening boards extending upward from two side edges of the base board, and a pair of elastic boards further extending upward from two free ends of the fastening boards, the elastic boards being inclined oppositely to each other and gradually far away from each other in the process of extending upward, two free ends of the pair of elastic boards being bent towards each other to form a pair of restraining portions, and a connecting terminal having a pair of elastic arms, and a bent portion connecting the pair of elastic arms together to make the connecting terminal show a substantial inverted-V shape, two free ends of the elastic arms being arched oppositely to each other to form a pair of interfering portions, wherein the connecting terminal is movably engaged with the pedestal terminal with the elastic arms restrained between the restraining portions and the interfering portions elastically abutting against insides of the corresponding elastic boards to realize an electrical connection between the connecting terminal and the pedestal terminal, the pedestal terminal is secured in the corresponding receiving cavity with the base board blocking under the receiving cavity, the two ends of the elastic boards adjacent to the restraining portions elastically rest against insides of the receiving cavity, the bent portion of the connecting terminal passes through the corresponding opening to movably project beyond the top surface of the insulating housing.

2. The electrical connector as claimed in claim 1, wherein each of the restraining portions has a restraining gap opened at a middle thereof, two side edges of each interfering portion oppositely protrude to form a pair of blocking portions, the connecting terminal can move upward and downward between the elastic boards, with the elastic arms being guided in the corresponding restraining gaps, the blocking portions can be blocked by the corresponding restraining portions to prevent the connecting terminal falling off the pedestal terminal.

3. The electrical connector as claimed in claim 1, wherein two opposite side faces of each receiving cavity define a pair of fastening grooves communicating with the receiving cavity, two opposite side edges of each of the fastening boards protrude outwards to form a plurality of fastening teeth fastened in the corresponding fastening grooves.

* * * * *